United States Patent [19]

Arevalo

[11] Patent Number: 4,801,145

[45] Date of Patent: Jan. 31, 1989

[54] LOTTERY DEVICE

[76] Inventor: Leonardo J. Arevalo, 1851 Center Rd., Novato, Calif. 94947

[21] Appl. No.: 62,229

[22] Filed: Jun. 15, 1987

[51] Int. Cl.[4] ..... A63B 71/06

[52] U.S. Cl. ..... 273/143 R; 401/195; 362/253

[58] Field of Search ..... 273/143 R, 143 A, 143 B, 273/143 C, 143 D, 143 E, 144 R, 144 A, 144 B; 401/195, 52; 362/118, 253

[56] References Cited

U.S. PATENT DOCUMENTS

| | | | |
|---|---|---|---|
| 2,979,602 | 4/1961 | Barnett | 401/195 X |
| 3,963,914 | 6/1976 | Browning et al. | 401/195 X |
| 4,541,630 | 9/1985 | Dirks | 273/144 B |

FOREIGN PATENT DOCUMENTS

| | | | |
|---|---|---|---|
| 0501005 | 2/1951 | Belgium | 273/143 R |
| 0532589 | 11/1954 | Belgium | 401/195 |
| 1022137 | 1/1958 | Fed. Rep. of Germany | 273/143 R |
| 1038961 | 9/1958 | Fed. Rep. of Germany | 401/195 |
| 2847347 | 5/1980 | Fed. Rep. of Germany | 273/143 R |
| 1546495 | 5/1967 | France | 401/195 |
| 2400738 | 3/1979 | France | 401/195 |
| 2563645 | 10/1985 | France | 401/195 |
| 0571319 | 1/1958 | Italy | 273/143 R |
| 7703549 | 1/1978 | Netherlands | 401/195 |
| 2142284 | 1/1985 | United Kingdom | 401/195 |

*Primary Examiner*—Carlton R. Croyle
*Assistant Examiner*—Eugene L. Szczecina, Jr.
*Attorney, Agent, or Firm*—Larry D. Johnson

[57] ABSTRACT

The invention provides a compact device for selecting the numbers to play in a game of chance, such as a lottery game. The device includes a number generator portion comprising a number wheel having a circumferential edge partitioned into segments, each bearing a different numerical indicia from the field of lottery numbers. A motor is connected to the number wheel so that when the motor is activated by a switch, the number wheel rotates about the motor axis. The number wheel and motor are contained in a housing having a window portion aligned so that only one of the numerical indicia of the number wheel is visible through the window at a time. By repetitive activation of the switch, a series of more or less random numbers will thus be generated. The housing can be configured so that it forms a relatively small, cylindrical barrel, suitable for attachment to a similarly-sized accessory portion such as a pen or flashlight.

2 Claims, 1 Drawing Sheet

LOTTERY DEVICE

BACKGROUND OF THE INVENTION

1. Field of the Invention

This invention relates generally to games and entertainment, and more specifically to an improved accessory for playing games of chance such as lottery games.

2. Description of the Prior Art

Lottery games and similar games of chance have become increasingly popular in recent years. Typically, such games require the player to select several specific numbers (e.g., six) from a field of numbers (e.g., forty-nine), and the game is won by those players who have chosen the correct specific numbers from the field. Thus the challenge, or entertainment value, is in selecting one's numbers to play.

While many players select their numbers by reference to lucky numbers, birth dates, license numbers, and the like, other players desire some assistance or guidance in selecting their numbers. Indeed, it is often difficult to select "random" numbers at all, especially when playing several lottery games together.

SUMMARY OF THE INVENTION

The lottery device of this invention provides a compact, portable accessory for selecting the numbers to play in a game of chance, such as a lottery game. The device includes a number generator portion comprising a number disc or wheel, with its circumferential edge partitioned into segments each bearing a different numerical indicia from the field of numbers to be selected from in the lottery. A small electric motor or other drive means is connected to the number wheel so that when the motor is activated by a switch, the number wheel spins or rotates about the motor axis. The number wheel and motor are contained in a housing having a window portion aligned so that only one of the numerical indicia of the number wheel is visible through the window at a time. Thus, when the switch is closed, the number wheel spins beneath the window, and when the switch is subsequently opened, the wheel slows to a halt to display a single number through the window. Accordingly, by repetitive activation of the switch, a series of more or less random numbers will be generated and displayed to the user.

The housing can be configured so that it forms a relatively small, cylindrical barrel, suitable for attachment to a similarly-sized accessory portion such as a writing instrument. Thus, a combined number generator/pen can be carried in the user's pocket, and used to both select the numbers to be played in a lottery, as well as to mark the lottery ticket with those numbers selected. Alternatively, the accessory portion could comprise a small flashlight or other suitable accessory.

DETAILED DESCRIPTION OF A PREFERRED EMBODIMENT

Figure 1:
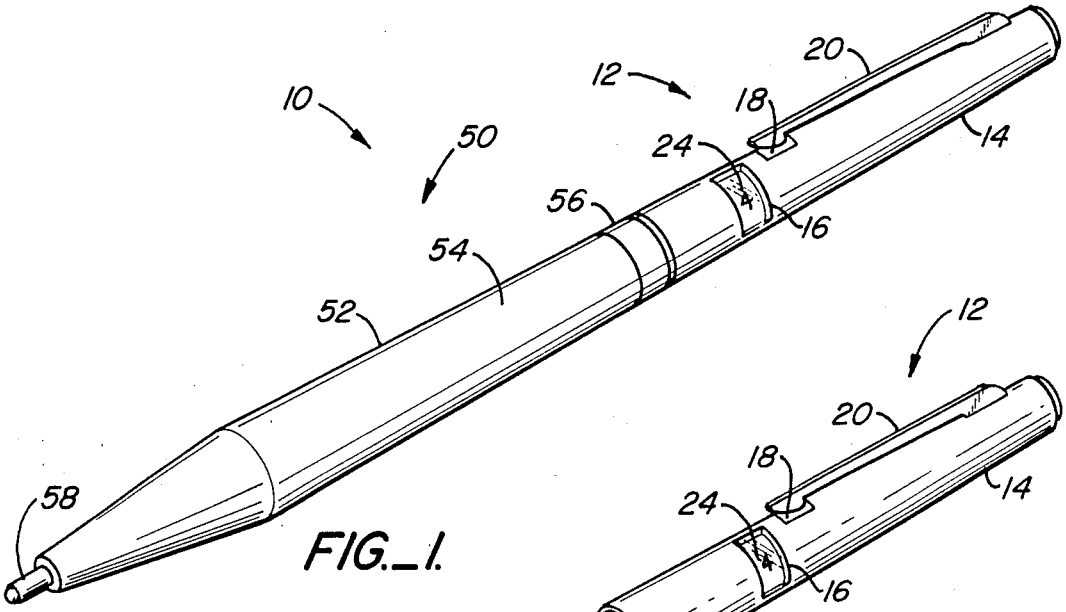
FIG. 1 is a perspective view of a lottery device of this invention, illustrating the combination of a number generator portion with a writing instrument portion, as connected together.

FIG. 1 is a perspective view of a lottery device 10, comprising a number generator portion 12 and an accessory portion 50 Number generator portion 12 includes a generally cylindrical housing 14, bearing a transparent window 16 through which a single numerical indicia 24 can be viewed. A switch 18 for activating a drive means, described infra, is incorporated onto a pocket clip 20 for enabling attachment to a user's pocket.

In this embodiment, accessory portion 50 comprises a writing instrument or pen portion 52. Pen 52 includes a barrel 54 of compatible size with housing 14, and bears a connecting end 56 for detachable engagement with housing 14. Writing tip 58 can be extended, for example, by rotation of barrel 54.

Figure 2:
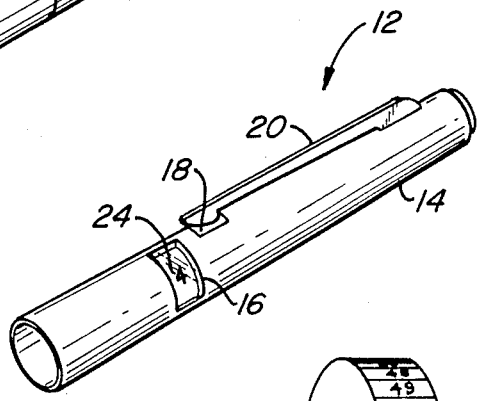
FIGS. 2 and 2*a* are a perspective view of an alternate embodiment of a lottery device, illustrating the combination of a number generator portion with a flashlight portion disconnected therefrom.
Figure 2A:
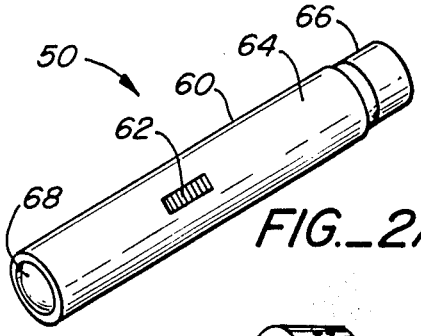

FIG. 2 is a partially exploded perspective view of an alternate embodiment of a lottery device, in which accessory portion 50 comprises a flashlight portion 60. Flashlight 60 includes a switch 62 on its body 64, with a connecting end 66 for detachable engagement with housing 14, and a lens 68 for illumination.

Figure 3:
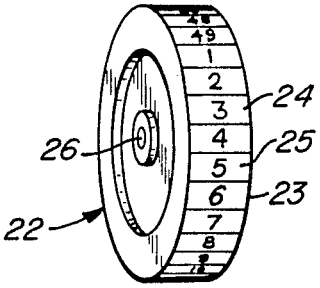
FIG. 3 is a perspective view of a number wheel of the number generator portion, illustrating a non-random (sequential) arrangement of the numerical indicia.

FIG. 3 is a perspective view of a number disc or wheel 22, having a circumferential edge 23 and a hub 26. A plurality of numerical indicia 24 are placed in segments 25 along edge 23, such that a different numerical indicia appears in each segment. Indicia 24 are selected from the field or pool of numbers to be selected from in a given game or lottery, and are placed in the segments along circumferential edge 23 in nonrandom or sequential fashion. In this example, the field of numerical indicia includes the numbers one through forty-nine, corresponding to the numbers used in at least one known lottery game (California). Alternatively, other lottery games may use a different field of numbers, for example one through forty, for which a correspondingly designed number wheel could be substituted.

Figure 3A:
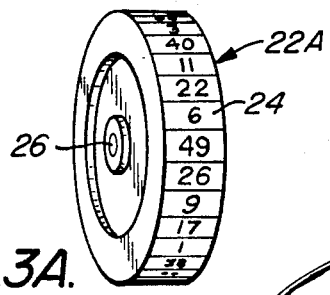
FIG. 3A is a perspective view of an alternate embodiment of a number wheel of the number generator portion, illustrating a random (non-sequential) arrangement of the numerical indicia.

FIG. 3A is a perspective view of an alternate number wheel 22A, in which the numerical indicia 24 are placed in random or non-sequential fashion about circumferential edge 23. The appearance of this non-sequential ordering may be preferable to some users in that it is suggestive of a more random number generation by the system, though it of course yields no more random results than the sequentially-ordered number wheel.

Figure 4:
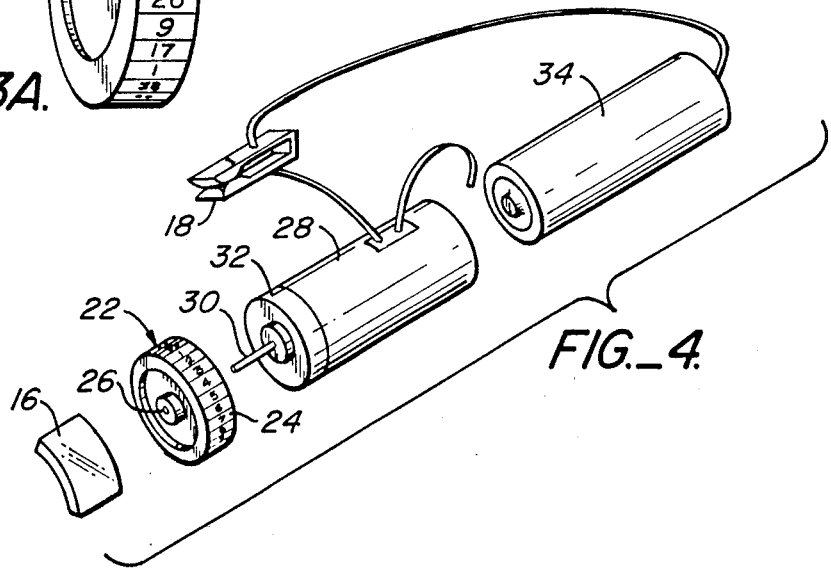
FIG. 4 is an exploded perspective view of the internal components of the number generator portion of the lottery device.

FIG. 4 is an exploded perspective view of the internal components of a number generator portion of the lottery device. Number wheel 22 is attached to and rotatable about shaft 30 of drive means or electric motor 28. Motor 28 may include an integral brake portion 32 for reducing the time necessary for the number wheel to slow to rest after rotation, thus expediting the number generating process. Electric motor 28 is powered by power supply means or battery 34, and is activated by switch 18.

While this invention has been described in connection with preferred embodiments thereof, it is obvious that modifications and changes therein may be made by those skilled in the art to which it pertains without departing from the spirit and scope of the invention. Accordingly, the scope of this invention is to be limited only by the appended claims.

What is claimed as invention is:

1. An apparatus for selecting a random number from a specified field of numbers comprising:

a disc portion having a circumferential edge, said edge being partitioned into a plurality of segments, each segment bearing a different numerical indicia corresponding to a single given number from said specified field of numbers;

drive means for rotating said disc about an axis, said drive means comprising motor and a battery;

switch means for activating said drive means; and housing means for containing said disc portion, drive means, and switch means, said housing means having a window portion for displaying only one of said disc portion numerical indicia at a time, said housing means being generally cylindrical in shape, and including a pocket clip portion for removable attachment to a users pocket, said pocket clip portion comprising said switch means, and said housing means including a writing instrument portion which is removable and replaceable with a flashlight portion; wherein when said switch means is closed, said drive means rotates said disc portion within said housing means, and when said switch means is open, said disc portion stops rotating and displays only one numerical indicia through said housing window.

2. The apparatus of claim 1 wherein the number of disc portion segments is equal to the quantity of numbers in said specified field of numbers, so that each number in said specified field of numbers is represented by a numerical indicia on a separate segment of said disc portion.

* * * * *